United States Patent [19]

Reddemann et al.

[11] Patent Number: 4,903,346

[45] Date of Patent: Feb. 27, 1990

[54] MULTI-PART PROTECTIVE HELMET

[75] Inventors: Hans Reddemann; Tronje von dem Hagen, both of Luebeck, Fed. Rep. of Germany

[73] Assignee: Drägerwerk Aktiengesellschaft, Lübeck, Fed. Rep. of Germany

[21] Appl. No.: 350,847

[22] Filed: May 11, 1989

[30] Foreign Application Priority Data

Jun. 25, 1988 [DE] Fed. Rep. of Germany ..... 3821513

[51] Int. Cl.[4] ..... A42B 3/02

[52] U.S. Cl. ..... 2/411

[58] Field of Search ..... 2/414, 6, 410, 411, 2/417, 418, 420, 422, 423, 424, 425

[56] References Cited

U.S. PATENT DOCUMENTS 3,107,356 10/1963 Pestronk et al. ..... 2/420
3,245,087 4/1966 Marchello ..... 2/422
3,324,255 6/1964 Romba ..... 2/6
4,821,344 4/1989 Kamata ..... 2/414

FOREIGN PATENT DOCUMENTS 2901088 7/1980 Fed. Rep. of Germany ..... 2/411

*Primary Examiner*—Werner H. Schroeder
*Attorney, Agent, or Firm*—McGlew & Tuttle

[57] ABSTRACT

A helmet with a forward face opening and a downward neck opening comprises a hard outer shell and a custom fittable and split inner shell which fits the head of the wearer without play, is easy to put on and take off, and has a high degree of mechanical stability and provides optimal wearer comfort. For this purpose the inner shell is connectable with the outer shell and it has a fixed inner contour custom fitted to the wearer's head, a one-piece outer shell is slipped over and forms the closure for the inner shell.

8 Claims, 1 Drawing Sheet

MULTI-PART PROTECTIVE HELMET

FIELD AND BACKGROUND OF THE INVENTION

The invention relates in general to a protective helmet and in particular to a new and useful protective helmet having interengageable inner and outer portions.

A protective helmet according to the invention is appropriate for situations where an exact fixation of the helmet with regard to the head of the user is required.

German Patent No. 29 01 088 describes an integral protective helmet whose outer shell can be split, and so can its inner shell, which is fixedly connected to the outer shell halves. This integral protective helmet encloses the head, the chin area and the cheeks. The custom-formable, inflatable inner part serves to fix the head inside the helmet. The helmet can be pulled off the head of the wearer once the valve of the inflatable inner part is opened or the helmet is split. The contact surfaces of the shells of the helmet are formed with a slot and feather interconnection, the shell halves being kept together by means of suitably disconnectable means in the shape of a strap around the two shell halves once the halves are joined.

It is disadvantageous in this known helmet that its mechanical stability is inferior compared to a helmet with a one-piece shell and that it does not fit the head without play as the inflatable insert can be fitted to the shape of the head only to a limited extent. An insert which is blown up too strongly also decreases the comfort. As the inner shell does not enclose the chin region from below, a rotation of the helmet in the direction of the body axis is possible.

Another known helmet for pilots comprises a hard outer shell and an inner shell which can be split into several parts custom fitted for the wearer and fixed inside the outer shell. The splitting is required to allow for an inserting and fixation of the shell halves inside the outer shell one by one. The inner shell can be glued in or be fixed by means of velcro-tape or such like.

The inner shell includes foam parts and encloses the hairy part of the head from the forehead down to the neck. Both the outer and the inner shell are slipped onto the head of the user at the same time. For this reason undercuts in the area of the inner contour of the inner shell are not possible. For reasons of fit the entering contour in the area of the neck opening is closed slightly conical in the described embodiment so that the helmet lies close in the cheek area. Such helmets are offered by several manufacturers, such as Gentex, type HGU-55/G, Foam Custom Fit Version. It is disadvantageous that considerable force has to be exerted during the putting on and taking off of the helmet due to the conical contour of the entrance, thus decreasing the overall comfort.

If additional instruments, such as optical target acquisition, are used, which are attached to the outer shell of the helmet, often the total play between head and helmet becomes too large as the inner shell encloses only a part of the head. In addition, acceleration forces and moments exerting force from outside on the helmet can only be received in those directions where a rotation of the head with regard to the helmet is not possible due to the geometrical design of the inner contour.

The outer and the inner shell of the helmet form a unit, the inner shell being custom fitted to the head of the individual wearer. Therefore each helmet is assigned to a single wearer. If the devices attached to the outer helmet shell are to be used by another pilot, the helmet has to be refitted or several complete special helmets have to be provided for every pilot. These solutions are time-consuming and expensive.

SUMMARY OF THE INVENTION

The present invention provides a protective helmet which fits the head of the wearer without play, can be slipped on and off easily, has a high degree of mechanical stability and has optimal wearing comfort. In addition, a speedy exchange of damaged helmet parts, especially of the outer shell, is possible.

The inventive helmet comprises two separate shells, a rigid outer shell and a split inner shell, whose fixed inner contour is custom fitted to the individual shape of the wearer's head. The slipped-on one-piece outer shell serves as a closure for the inner shell. The invention has the advantage that the inner shell fits the head of the wearer without play since it is custom-fitted. Furthermore, for an exchange of the outer shell, a new shell from the magazine can be slipped onto the same inner shell. The custom-fitted inner shell is required only once per person. When used as a pilot helmet, the outer shell equipped with expensive electronic devices has to be provided only once per aircraft as it can be combined with any custom-fitted inner shell.

It is advantageous to provide the inner shell in the chin area with a tapered neck opening which encloses and grips the chin from below. By this means a stronger fixation of the inner shell with regard to the head is achieved. A sliding backward of the helmet is avoided in particular. A rotation of the helmet around the axis of the body is no longer possible either.

It is advantageous to manufacture the inner shell so that it can be split at the vertex or crown level. In this case it can be closed over the head easily due to its chin-encasing contour. Therefore undercuts in the area of the inner contour of the inner shell are possible. The two shell halves are held together by at least one hinge and an elastic strap at their contact level. The hinge guarantees the connection of the halves to one another and the elastic strap provides a bias in the closing direction. The elastic strap can also be executed in the form of a spring, e.g. combined with a hinge. By means of these elements the inner shell is fixed to the head, so that the outer shell can be slipped over the inner shell without any particular exertion of force.

For the fixation of the outer shell on the inner shell it is advantageous to form the inner contour of the outer shell in correspondence with the outer contour of the inner shell so that the circumferential contour of the contact surface increases from the top to the neck surface. If the contact surface has e.g. a conical shape, the outer shell can be slipped onto the inner shell without play. Due to the form-locking shape of the helmet between the inner and the outer shells, forces and moments from all directions can be received, furthermore requirements of exactitude for optical aid regarding a fixation of the head inside the protective helmet are met. The standardization of the inner contour of the outer shell to the outer contour of the inner shell makes it possible to slip any outer shell provided with any equipment onto any custom-fitted inner shell. The devices connected to the outer shell can be used by several helmet wearers by simply exchanging the outer shells.

For a clear fixation and adjustment of the correct position of the outer shell on the inner shell it is advantageous to construct the inner shell in a non-circular shape. By this means a rotation of the outer shell with regard to the inner shell is avoided. Elevations on the inner shell engaging with respective recesses in the outer shell fulfill the same purpose.

Accordingly, it is an object of the invention to provide an improved protective helmet which comprises an inner shell portion having a split inner shell which is custom fitted to a wearer and an outer hard shell having an interior surface which conforms to and fits over the inner shell and advantageously locks with the inner shell against rotation relative thereto.

A further object of the invention is to provide a method of protecting a person's head which comprises custom fitting an inner shell portion to the person's head and making it of two parts which are hinged together so that it may be easily closed over and removed from the person's head, forming an outer protective shell portion having an inner contour which fits over and engages with the outer contour of the inner shell and contouring the shell so that they interengage so that they may not rotate relative to one another.

A further object of the invention is to provide a helmet which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figure 1:
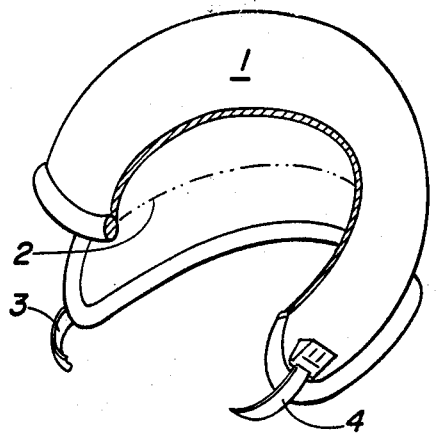
FIG. 1 is a perspective representation of the outer helmet shell.

Referring to the drawings in particular, the invention embodied therein comprises a protective helmet which includes an inner shell portion 5 and an outer shell portion 1 which are interfitted. The outer shell portion being engaged over the inner shell portion after the inner shell portion is first fashioned to the contour of the wearer's head. The inner shell portion 5 is advantageously finished to the contour of a particular wearer and includes a construction such as projecting chin area 14 which ensures accurate positioning of the inner shell portion over the wearer's head. In addition, in order to facilitate the on and off movement of the inner portion 5, the inner portion is made of two parts, 6 and 7 which are hinged together such as by a hinge 9 so that they may be folded along a front and rear separation line 16 outwardly to easily remove the helmet when desired.

FIG. 1 shows an embodiment of the outer helmet shell 1 with a standardized inner contour 2. The circumference of the inner contour 2 of the outer shell 1 decreases from the neck opening to the top, e.g. in a conical shape, to guarantee a play-free fit of the outer shell 1 on the inner shell 5. Straps 3 inflexible in the lengthwise direction and fixed by means of a closing mechanism serve for the fastening of the outer helmet shell 1 to the head. In addition, the outer shell 1 can contain a telephone set with a listening device (not shown).

Figure 2:
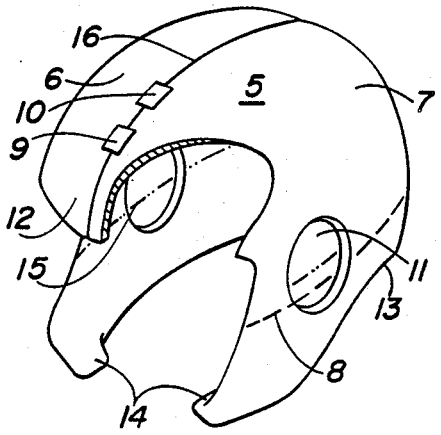
FIG. 2 is a perspective representation of the inner helmet shell.

The inner shell 5 shown in FIG. 2 comprises the two halves 6 and 7 the embodiment of whose circumferential contour 8 matches that of the inner contour 2 of the outer shell 1. The two halves 6 and 7 are closable by means of a hinge 9. The elastic strap 10 prevents an unintended opening and holds the two halves 6 and 7 together until the outer shell 1 is slipped on. The hinge 9 and the elastic strap 10 are let in, in order not to disrupt the circumferential contour 8. The ear area 11 is opened in each of the halves 6 and 7 in order to allow for an appropriate acoustic coupling with a listening or receiver device (not shown).

The two halves 6 and are individually fitted onto the head of the wearer with expansion foam. They cover a forehead area 12, a neck area 13 and they enclose the chin area 14. Due to the contour of the inner shell 5 around at chin area 15 a relative movement of the inner shell relative to the head is substantially excluded. To put them on and take them off, the halves 6 and 7 are closed and opened by folding at the hinge 9. It is not possible to open the inner shell 5 when the outer shell 1 is slipped over the inner shell 5. The outer shell 1 is the closure for the inner shell 5.

While a specific embodiment of the invention has been shown and described in detail to illustrate the application of the principles of the invention, it will be understood that the invention may be embodied otherwise without departing from such principles.

What is claimed is:

1. A protective helmet comprising an inner shell which is custom fittable and is formed of at least two connected inner shell split portions and an outer hard protective shell which is engageable over said split inner shell so that together the inner shell and the outer shell provide a face opening and a neck opening, said inner shell having a fixed interior contour fitted to the wearer's head, said outer shell being of one piece with an interior contour to engage over said inner shell.

2. A protective helmet according to claim 1, wherein said inner shell has a tapered neck opening in an area overlying the wearer's chin.

3. A protective helmet according to claim 1, wherein said inner shell has an exterior contour around its exterior surface proceeding from the front of said inner shell toward the crown and over to the back thereof, which is complementary to the inner circumference of said outer shell so that they may be interfitted together.

4. A protective helmet according to claim 3, wherein said inner shell has a non-circular circumferential contour.

5. A protective helmet comprising an inner shell formed of two shell parts, means interconnecting said two shell parts of said inner shell together permitting their pivotal separation for removal of said shell parts from the wearer's head, an outer protective hard shell part having an interior contour complementary to the exterior contour of said inner shell for interfitting engagement over said inner shell, said outer shell holding said interconnecting parts of said inner shell together over the wearer's head.

6. A protective helmet according to claim 5, wherein said means interconnecting said inner shell parts comprises a hinge pivoting said shell parts along a central line proceeding from the forehead over the crown of the head to the rear and a spring holding said shell parts together in an erected position over the wearer's head.

7. A protective helmet according to claim 6, wherein said inner shell includes an opened portion on each side for receiving an earpiece, said inner shell having a lower portion with a projection to engage over the area of the chin of the wearer and the exterior contour of said inner shell being non-spherical so as to prevent the rotation of said outer shell after it is engaged on said inner shell.

8. A protective helmet comprising an inner shell which is custom fittable and is formed of at least two split portions and an outer hard protective shell which is engageable over said split inner shell so that together they have a face opening and a neck opening, said inner shell having a fixed interior contour fitted to the wearer's head, said outer shell being of one piece with an interior contour to engage over said inner shell, said inner shell including two shell portions which are connected together along a central front and rear split line and means permitting pivotal spring biasing interconnection of said shell portions with a quick removal of said inner shell from the person's head.

* * * * *